United States Patent [19]

Ishikawa et al.

[11] Patent Number: 4,475,468

[45] Date of Patent: Oct. 9, 1984

[54] INCINERATOR WITH MOVING-BED STOKER

[75] Inventors: Tokihiko Ishikawa, Yokohama; Takehiko Motomura, Funabashi, both of Japan

[73] Assignee: Ishikawajima-Harima Jukogyo Kabushiki Kaisha, Japan

[21] Appl. No.: 494,934

[22] Filed: May 16, 1983

[51] Int. Cl.[3] ..... F23G 5/00

[52] U.S. Cl. ..... 110/257; 110/101 A; 110/270; 110/273; 110/329

[58] Field of Search ..... 110/268, 269, 270, 271, 110/272, 273, 286, 291, 298, 299, 328, 329, 330, 101 R, 101 A, 257; 126/152 B, 163 R; 266/178, 179, 180; 414/173, 174, 178

[56] References Cited

U.S. PATENT DOCUMENTS

| | | | |
|---|---|---|---|
| 2,471,797 | 5/1949 | Thomas | 110/286 |
| 2,666,404 | 1/1954 | Kessler | 110/329 |
| 3,962,977 | 6/1976 | Calame et al. | 110/329 |
| 4,308,034 | 12/1981 | Hoang | 110/270 |
| 4,337,857 | 7/1982 | Schneider | 110/328 |

*Primary Examiner*—Edward G. Favors
*Assistant Examiner*—Steven E. Warner

[57] ABSTRACT

An incinerator with a moving-bed stoker in which a chain conveyor is inclined in the direction of its movement and a plurality of fuel- or fire-bed members L-shaped in cross section are mounted on the links of the chain conveyor, whereby a step-like moving fuel- or fire-bed is defined. Each fuel- or fire-bed member comprises an upright or vertical plate and a horizontal plate and combustion air injection holes are formed through the upright or vertical plate so that the foreign matter such as ash, metal pieces or the like as well as the molten ash produced as the result of the combustion of waste with a low melting point can be prevented from falling through the combustion air holes into the stoker.

2 Claims, 3 Drawing Figures

INCINERATOR WITH MOVING-BED STOKER

BACKGROUND OF THE INVENTION

The present invention relates to an incinerator with a moving-bed stoker and more particularly an incinerator with moving-bed stoker in which ash, foreign matter such as metal pieces and molten ash produced as the result of combustion of waste, fuels and the like with a low melting point can be avoided from falling down through combustion air injection holes provided in stoker fuel- or fire-bed plates for suppling air for burning waste, fuels and the like.

A conventional incinerator with a moving-bed stoker comprises in general a chain conveyor passed around two spaced apart sprocket wheels and fuel- or fire-bed plates are securely mounted on rings of the chain conveyor with anchoring bars, whereby a continuous moving fuel- or fire-bed is defined along which combustibles are transported in the direction of the movement of the chain conveyor and are burned. Each fuel- or fire-bed plate is formed with a plurality of combustion air injection holes arranged in the form of a checkerboard or grate so that the combustion air is directed upwardly.

As described above, the combustion air injection holes are opened at the upper surface of the fuel- or fire-bed plate so that when the combustibles contain foreign matter such as ash, metal pieces and waste (plastics, metals and the like) with a low melting point, molten ash flows down through the combustion air injection holes, causing the breakdown of the stoker. In addition, inspection and maintenance operations must be carried out frequently in order to remove ash, metal pieces and molten ash from the stoker. As a result, the operation efficiency is low. In order to overcome this problem, a large amount of combustion air greater than required for combustion must be supplied and the amount of combustion air supplied must be controlled depending upon kinds of combustibles.

The present invention was made to overcome the above and other problems encountered in the conventional incinerators.

The primary object of the present invention is therefore to provide an incinerator with a moving-bed stoker which has a high degree of durability and which can effectively prevent foreign matter such as ash, metal pieces and the like, and molten ash produced as the result of combustion of waste, fuel and the like with a low melting point from falling through the combustion air injection holes of fire-bed plates of the stoker, whereby cost and labor required for inspection and maintenance can be much reduced.

The above and other objects, features and effects of the present invention will become more apparent from the following description of the preferred embodiments thereof taken in conjunction with the accompanying drawings.

DESCRIPTION OF THE PREFERRED EMBODIMENTS

Figure 1:
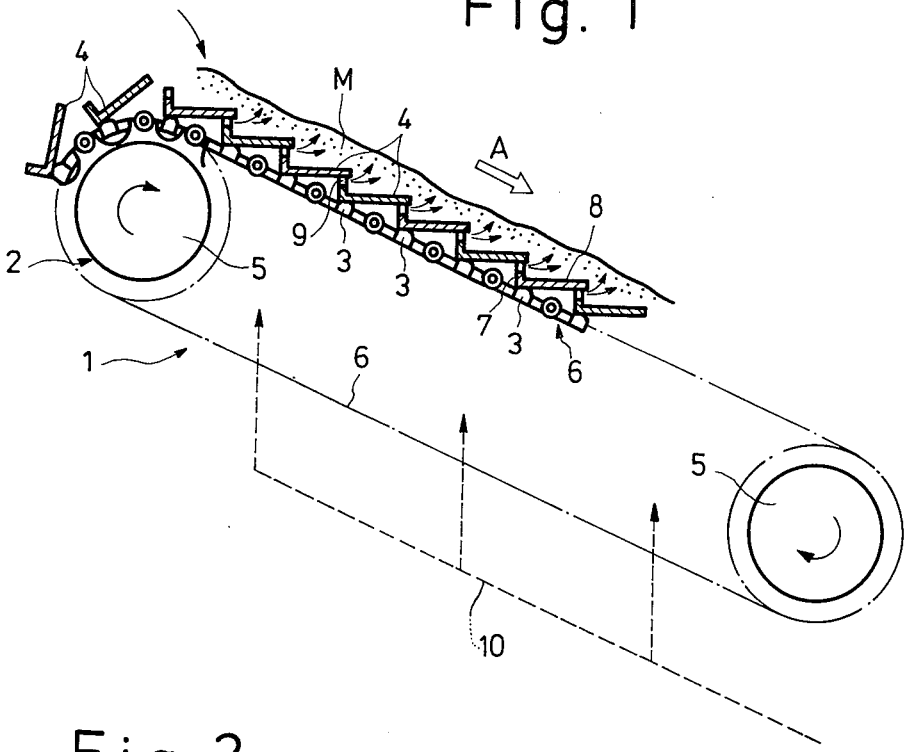
FIG. 1 is a schematic longitudinal sectional view of a first embodiment of a moving-bed stoker in accordance with the present invention.

Referring first to FIG. 1, a moving-bed stoker generally indicated by the reference numeral 1 is disposed within an incinerator (not shown). The moving-bed stoker 1 comprises in general a chain conveyor 2 and a plurality of fuel- or fire-bed members 4 pivotably mounted on links 3 of the chain conveyor 2 so as to cover the links 3.

The chain conveyor 2 comprises two sprocket wheels 5 whose shafts are disposed in parallel with each other and an endless chain 6 passed around the sprocket wheels 5. The chain conveyor 2 is inclined at an angle in the direction A in which the combustibles are moved.

Figure 2:
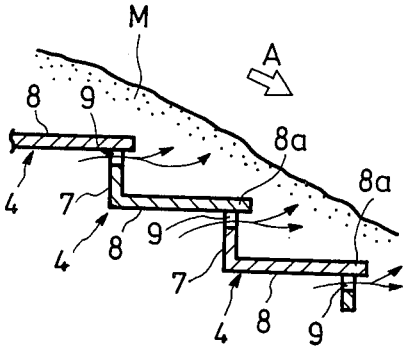
FIG. 2 is a fragmentary sectional view, on enlarged scale, thereof.

Each of the fuel- or fire-bed members 4 on the links 3 of the endless chain 6 comprises, as best shown in FIG. 2, an upright or vertical plate 7 and horizontal plate 8. Therefore the fuel- or fire-bed member 4 has an L-shaped cross sectional configuration. The horizontal plate 8 of the fire-bed member 4 is so extended that its leading edge portion 8*a* rests on the upper end of the upright or vertical plate 7 of the preceding or downstream fuel- or fire-bed member 4, whereby a step-like moving fire-bed carrying combustibles M can be defined. The upper end or edge of the upright or vertical plate 7 of the fuel- or fire-bed member 4 is formed with notches so that when the horizontal plate 8 of the succeeding or upstream fuel- or fire-bed member 4 rests on the upright or vertical plate 7 of the preceding or downstream fuel- or fire-bed member 4, combustion air injection holes 9 are defined. The combustion air is supplied through a combustion air supply line generally indicated by the reference numeral 10.

Next the mode of operation of the first embodiment with the above-described construction will be described. Combustibles M such as waste, fuel and the like are charged on the moving fuel- or fire-bed at the upper end of the stoker 1 and are moved over the fuel- or fire-bed members 4 as the chain conveyor 2 is moved. While the combustibles M are moved, they are supplied and mixed with the combustion air injected through the combustion air injection holes 9 defined between the upright or vertical plates 7 of the preceding or downstream fuel- or fire-bed members 4 and the horizontal plates 8 of the succeeding or upstream and fuel- or fire-bed members 4, whereby the combustibles M are burned.

Foreign matter such as ash, metal pieces and the like contained in the combustibles M and molten ash produced by the combustion of waste with a low melting point (plastics, metals and the like) are moved on the horizontal plates 8 of the fuel- or fire-bed members 4. According to the embodiment, the combustion air injection holes 9 are formed or defined through the upright or vertical plates 7 not the horizontal plates 8 of the fuel- or fire-bed members 4 so that the injection combustion air flows horizontally and consequently the foreign matter and the molten ash can be prevented from falling through the combustion air injection holes 9 into the moving-bed stoker 1. Furthermore since the horizontal plate 8 of the succeeding or upstream fuel- or fire-bed member 4 which rests on the upright or vertical plate 7 of the preceding or downstream fuel- or fire-bed member 4 extends beyond the upper end or edge of the upright or vertical plate 7 like eaves so that even when a small amount of combustion air is injected through the holes 9, the foreign matter and the molten ash can be prevented from falling through the injection holes 9.

As described above, the foreign matter and the molten ash can be prevented from falling through the combustion air injection holes 9 into the moving-bed stoker 1 so that damage to the chain conveyor 2 due to the foreign matter and the molten ash can be avoided. As a result, the cost and labor for maintenance can be considerably reduced and the operation efficiency can be much improved. Furthermore it is no longer needed to inject a large amount of combustion air through the injection holes 9 in order to prevent the foreign matter and the molten ash from falling into the holes 9.

Figure 3:
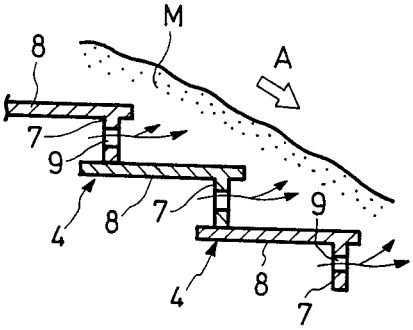
FIG. 3 is a fragmentary sectional view, on enlarged scale, of a second embodiment of the present invention.

A second embodiment shown in FIG. 3 is substantially similar in construction to the first embodiment described above with reference to FIGS. 1 and 2 except that the upright or vertical plate 7 is extended downward from the horizontal plate 8 adjacent the leading edge thereof.

The upright or vertical plates 7 and the horizontal plates 8 may be suitably modified in shape and arrangement as far as a step-like moving fuel- or fire-bed can be defined. Furthermore the shape and number of the combustion air injection holes 9 are not defined. For instance, the combustion air injection holes 9 may be extended at the midpoint between the upper end lower ends of the vertical plates 7 as shown in FIG. 3.

The effects and features of the present invention may be summarized as follows:

(1) Each fuel- or fire-bed member 4 is L-shaped in cross section and combustion injection holes are formed through the upright or vertical plate 7 thereof. As a result, foreign matter such as ash, metal pieces and the like as well as the molten ash produced as the result of the combustion of waste with a low melting point can be prevented from falling through the combustion air holes into the stoker. Consequently durability and maintainability of the moving-bed stoker can be remarkably improved.

(2) The amount of combustion air supplied through the combustion air injection holes 9 can be easily controlled so that it can be avoided to supply an excess of combustion air.

(3) The incinerator in accordance with the present invention is very simple in construction and easy to fabricate yet highly reliable and dependable in operation.

What is claimed is:

1. In an incinerator, a movable-bed stoker comprising a chain conveyor having links thereon and inclined at an angle in a direction of its movement, means for moving said conveyor, and a plurality of fuel- or fire-bed members pivotably mounted on said links so as to cover said links, whereby a movable fuel- or fire-bed movable in unison with said chain conveyor is defined, each fuel- or fire-bed member being L-shaped in cross-section and comprising a horizontal plate and a vertical plate, said members being pivotable during movement of the conveyor so that a horizontal plate of one fuel- or fire-bed member will engage with the vertical plate of an adjacent fuel- or fire-bed member, and combustion air injection holes formed only through the vertical plates of said fuel- or fire-bed members, the vertical plate of each fuel- or fire-bed member extending upwardly from an upstream edge of the horizontal plate thereof, and notches being formed at an upper edge of said vertical plate, said combustion air injection holes being formed when the horizontal plate of a succeeding or upstream fuel- or fire-bed member engages the upper edge of the vertical plate of a preceding or downstream fuel- or fire bed member.

2. In an incinerator, a movable-bed stoker comprising a chain conveyor having links thereon and inclined at an angle in a direction of its movement, means for moving said conveyor, and a plurality of fuel- or fire-bed members pivotably mounted on said links so as to cover said links, whereby a movable fuel- or fire-bed movable in unison with said chain conveyor is defined, each fuel- or fire-bed member being L-shaped in cross-section and comprising a horizontal plate and a vertical plate, said members being pivotable during movement of the conveyor so that a horizontal plate of one fuel- or fire-bed member will engage with the vertical plate of an adjacent fuel- or fire-bed member, and combustion air injection holes formed only through the vertical plates of said fuel- or fire-bed members, the vertical plate of each fuel- or fire-bed member extending downwardly from the horizontal plate thereof adjacent to a downstream edge of said horizontal plate, said combustion air injection holes being formed through said vertical plate.

* * * * *